US008636317B2

(12) United States Patent
Wu

(10) Patent No.: US 8,636,317 B2
(45) Date of Patent: Jan. 28, 2014

(54) LIFT CHAIR

(75) Inventor: Shu-Yao Wu, Taichung (TW)

(73) Assignee: Strength Master Fitness Tech Co., Ltd., Taichung (TW)

( * ) Notice: Subject to any disclaimer, the term of this patent is extended or adjusted under 35 U.S.C. 154(b) by 219 days.

(21) Appl. No.: 13/195,106

(22) Filed: Aug. 1, 2011

(65) Prior Publication Data

US 2011/0278883 A1 Nov. 17, 2011

Related U.S. Application Data

(63) Continuation-in-part of application No. 12/772,343, filed on May 3, 2010, now abandoned.

(51) Int. Cl.
*A47C 4/00* (2006.01)
*A47C 1/00* (2006.01)

(52) U.S. Cl.
USPC ..... 297/19; 297/30; 297/35; 297/330

(58) Field of Classification Search
USPC ..... 297/19, 30, 35, 316, 330
See application file for complete search history.

(56) References Cited

U.S. PATENT DOCUMENTS

| | | | | |
|---|---|---|---|---|
| 2,571,463 | A * | 10/1951 | Lorenz | 297/29 |
| 2,710,645 | A * | 6/1955 | Luckhardt | 297/38 |
| 4,076,303 | A * | 2/1978 | Korenblit | 297/30 |
| 4,623,194 | A * | 11/1986 | Pillot | 297/316 |
| 4,792,181 | A * | 12/1988 | Guichon | 297/28 |
| 6,142,568 | A * | 11/2000 | Abelbeck et al. | 297/344.17 |
| 6,692,068 | B1 * | 2/2004 | Tang | 297/16.2 |
| 6,902,231 | B1 * | 6/2005 | Tseng | 297/27 |
| 7,063,380 | B1 * | 6/2006 | Cui | 297/30 |
| 7,628,450 | B2 * | 12/2009 | Castagnola et al. | 297/38 |
| 2006/0238007 | A1 * | 10/2006 | Lin | 297/330 |
| 2011/0266840 | A1 * | 11/2011 | Wu | 297/41 |

* cited by examiner

*Primary Examiner* — Philip Gabler
(74) *Attorney, Agent, or Firm* — Rosenberg, Klein & Lee

(57) ABSTRACT

A lift chair includes a base, a seat mechanism and a driving module. The seat mechanism includes a back frame, a seat frame, a foot frame and two hand rails. The seat frame is pivotally coupled to the base, and the driving module installed between the base and the seat mechanism drives the seat mechanism to perform a motion with respect to the base, so that if a user wants to stand up, the user can use the support from the seat frame and the back frame as standing aids to stand up successfully.

4 Claims, 13 Drawing Sheets

LIFT CHAIR

CROSS-REFERENCE TO RELATED APPLICATION

This application is a Continuation-In-Part application of Ser. No. 12/772,343, filed on May 3, 2010, and entitled "Foldable assistive stand-up chair", now pending.

BACKGROUND OF THE INVENTION

1. Field of the Invention

The present invention relates to a chair structure, and more particularly to a chair that aids a user to stand up from the chair.

2. Brief Description of the Related Art

With reference to U.S. Pat. No. 7,628,450 and a related drawing as shown in FIG. 23, a chair is provided for a user to sit thereon, and the user simply needs to adjust a control unit 71 (such as the component represented by the numeral 60 in the U.S. Pat. No. 7,628,450) to set a backrest of the chair flatly backward, if the user wants to lie on his/her back.

Although the chair as disclosed in U.S. Pat. No. 7,628,450 provides dual functions, yet this patent still cannot overcome the problem that elderly users or people with mobility problems cannot stand up from the chair successfully due to their deteriorated knees.

With reference to U.S. Pat. No. 7,090,296 and a related drawing as shown in FIG. 24, a design similar to that of the aforementioned U.S. Pat. No. 7,628,450 is provided for users to lie on their back, but this patent still provides no standing aid to assist users to stand up from the chair. In other words, this patent comprises a component 72 similar to a hydraulic cylinder or a pneumatic cylinder, but this component 72 simply drives the backrest to elevate and provides a shock absorbent effect during the elevation process only. In FIGS. 2 and 3 of U.S. Pat. No. 7,090,296, the whole chair does not come with any standing aid design, and it cannot achieve the foregoing expected effect.

As described above, the conventional chairs just provide a design for users to lie on their back, but do not provide any standing aid design to help users to stand up from the chair. Obviously, the conventional chairs require improvements.

SUMMARY OF THE INVENTION

Therefore, it is a primary objective of the present invention to overcome the aforementioned problem by providing a lift chair, wherein the lift chair comprises a base, a seat mechanism pivotally coupled to the base, and a driving device for driving the seat mechanism to move with respect to the base, such that when a user wants to stand up, the user's back and hip can be supported by forward and upward supporting forces of a back frame and a seat frame, so to achieve the standing aid effect.

To achieve the foregoing objective, the present invention adopts the following technical measures, wherein the lift chair comprises:

a base, including a front base frame, a rear base frame, and a connecting element for limiting relative positions of the front base frame and the rear base frame;

a seat mechanism, including a back frame, a seat frame, a foot frame and two hand rails, and a front section of the seat frame being pivotally coupled to the front base frame and the foot frame, and a rear section of the seat frame being pivotally coupled to the back frame, and an end of the foot frame being pivotally coupled to the front section of the two hand rails, and a rear section of the two hand rails being pivotally coupled to the back frame, and the bottom of the back frame being pivotally coupled to a link, and the link being pivotally coupled to the rear base frame; and a driving device, having an end pivotally installed at the front base frame, and another end pivotally coupled to the link, and a pivot position of the seat frame and the front base frame being a rotation center, and the driving device driving the link, such that the seat frame, the back frame, the front frame and the hand rails can be moved and pivoted.

To achieve the foregoing objective, the present invention also adopts the following technical measures, wherein the lift chair comprises:

1. a base, including a front base frame, a rear base frame, and a connecting element for limiting relative positions of the front base frame and the rear base frame;

a seat mechanism, including a back frame, a seat frame, a foot frame and two hand rails, and a front section of the seat frame being pivotally coupled to the front base frame and the foot frame, and a rear section of the seat frame being coupled to the back frame, and an end of the foot frame being pivotally coupled to a front section of the two hand rails, and a rear section of the two hand rails being pivotally coupled to the back frame, and the bottom of the back frame being pivotally coupled to a link, and the link being pivotally coupled to the connecting element; and a driving device, having an end pivotally installed at the front base frame, and another end pivotally coupled to the seat frame, and a pivot position of the seat frame and the front base frame acting as a rotation center, and the driving device driving the seat frame, such that the seat frame, the back frame, the foot frame and the hand rails can be moved and pivoted.

BRIEF DESCRIPTION OF THE INVENTION

DETAILED DESCRIPTION OF THE PREFERRED EMBODIMENTS

Figure 1:
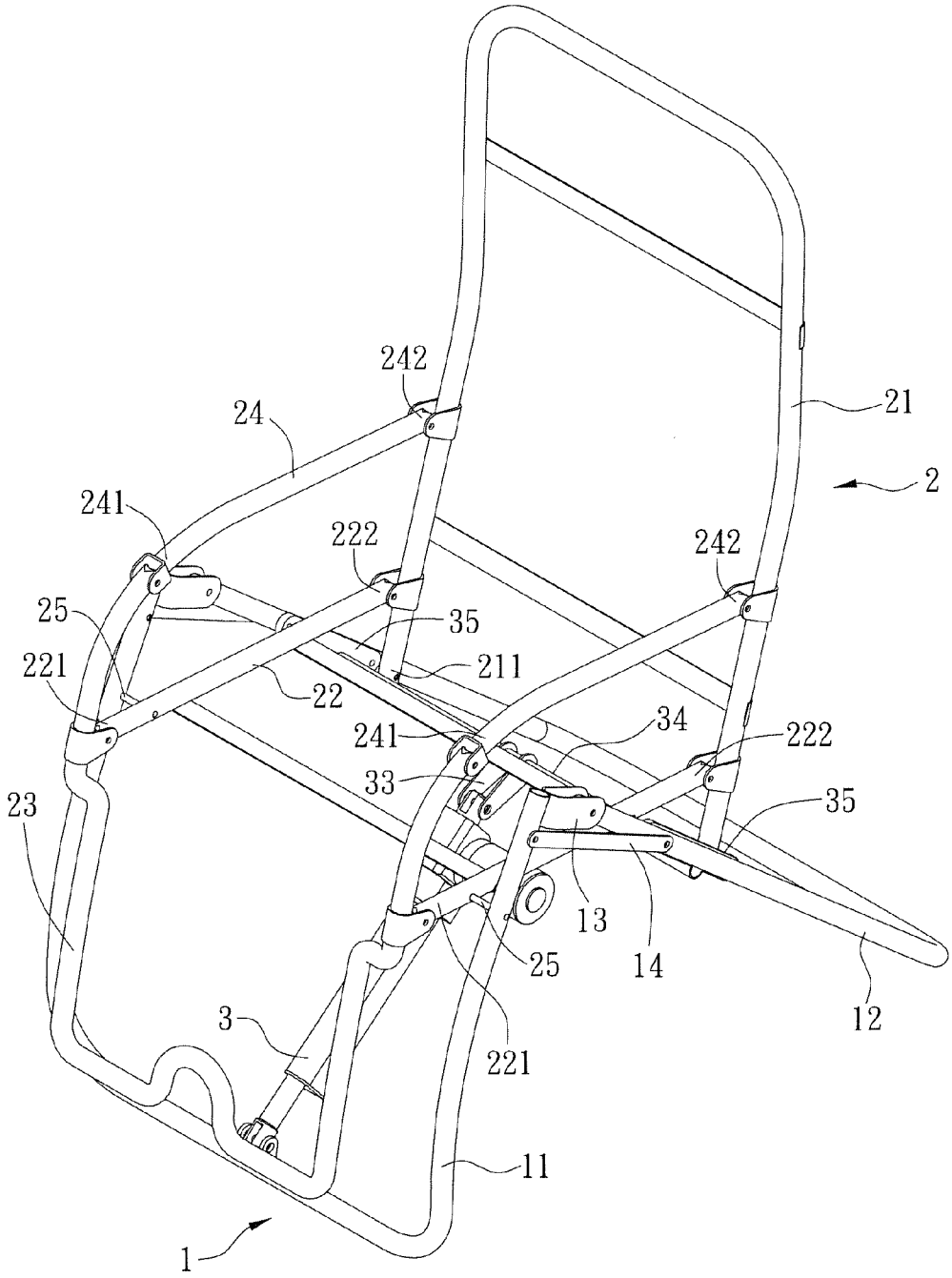
FIG. 1 is a perspective view of a first preferred embodiment of the present invention.

With reference to FIGS. 1 to 11 for the first preferred embodiment of the present invention, the embodiment is provided for illustrating the present invention only, but not intended for limiting the scope of the present invention.

In FIGS. 1 to 4 for the lift chair in accordance with the first preferred embodiment of the present invention, the lift chair comprises the following elements:

A base 1 includes a front base frame 11 and a rear base frame 12, both having a substantially U-shaped bent design, and the top of the front and rear base frames 11, 12 are coupled by a fixing element 13, and the front and rear base frames 11, 12 are coupled by a connecting element 14 for limiting their relative positions, and the fixing element 13 comes with a design capable of separating the front base frame 11 and the rear base frame 12, such that when the front and rear base frames 11, 12 are folded and stored, they can be separated from one another to facilitate the folding and storage, and both ends of the connecting element 14 are respectively and pivotally coupled to the front and rear base frames 11, 12, and the bottoms of the front and rear base frames 11, 12 are disposed apart from one another, so that the front and rear base frames 11, 12 can be tilted and set up.

A seat mechanism 2 includes a substantially n-shaped back frame 21, a substantially rectangular seat frame 22, a substantially U-shaped foot frame 23 and two left and right hand rails 24, and the seat frame 22 is disposed between the front and rear base frames 11, 12, and a front section of the seat frame 22 is pivotally coupled to both left and right sides of the front base frame 11, and an end 221 of the front section of the seat frame 22 is pivotally coupled to both left and right sides of the foot frame 23, and an end 222 of a rear section of the seat frame 22 is pivotally coupled to both left and right sides of the back frame 21, and both left and right sides of an end of the foot frame 23 are pivotally coupled to a front section 241 of the two hand rails 24, and an end of a rear section of the two hand rails 24 is pivotally coupled to both left and right sides of the back frame 21, and an end 211 of the bottom of the back frame 21 is pivotally coupled to a link 30, and the link 30 is pivotally coupled to the rear base frame 12, and the link 30 includes a connection part 33, a driving part 34 and two transmission parts 35, wherein both ends of the driving part 34 are fixed to a body portion of the transmission part 35, and an end of the connection part 33 is fixed to the central position of the body portion of the driving part 34, and another end of the connection part 33 is pivotally coupled to the driving device 3, while an end of the transmission part 35 is coupled to the rear base frame 12 and another end of the transmission part 35 is coupled to the end 211 of the bottom of the back frame. Of course, the back frame 21 and the seat frame 22 can further include a back cushion and a seat cushion (not shown in the figure) installed thereon respectively and provided for the user to rest on the cushions.

A driving device 3 has an end pivotally coupled to the front base frame 11 and another end pivotally coupled to another end of the connection part 33, and the driving device 3 can be a hydraulic cylinder, a pneumatic cylinder, a lifting motor or a linear actuator that can be operated stretchably, and the driving device 3 further includes an operating interface (not shown in the figure) provided for a user to control the motion and dynamic gesture of the lift chair.

With the aforementioned design, a pivot position 25 of the seat frame 22 and the front base frame 11 acts as a rotation center, and the driving device 3 drives the link 30, so that the seat frame 22, the back frame 21, the foot frame 23 and the hand rails 24 can be turned pivotally.

Figure 3:
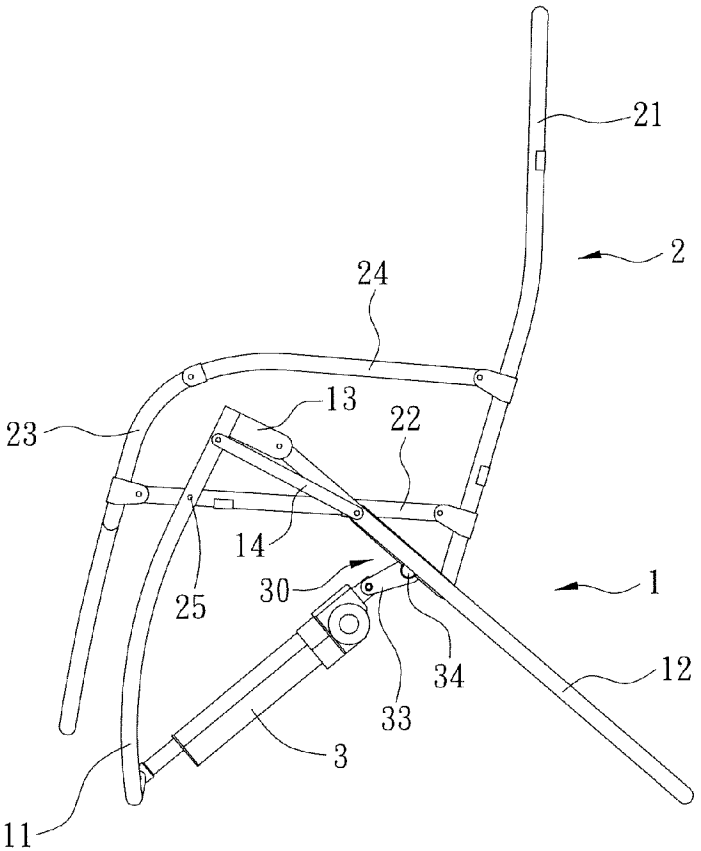
FIG. 3 is a side view of the first preferred embodiment of the present invention.
Figure 2:
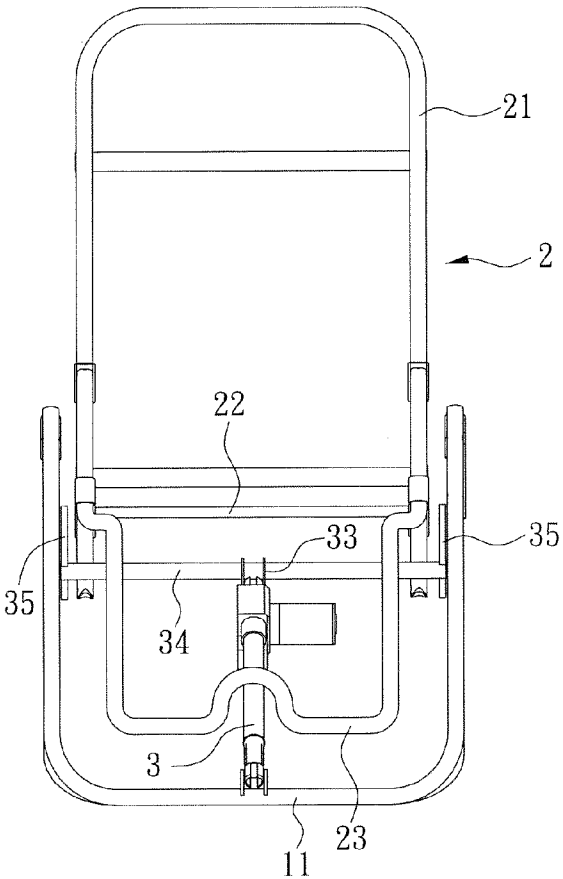
FIG. 2 is a front view of the first preferred embodiment of the present invention.
Figure 4:
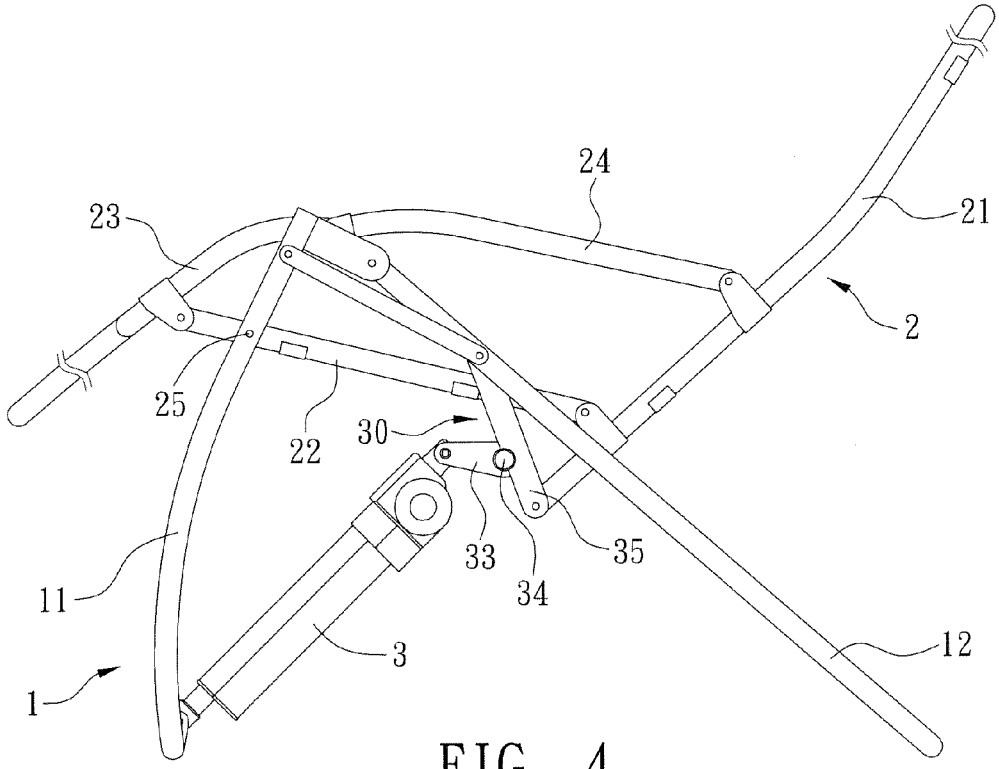
FIG. 4 is a side view showing a slightly lying-on-the back status of the first preferred embodiment of the present invention.
Figure 5:
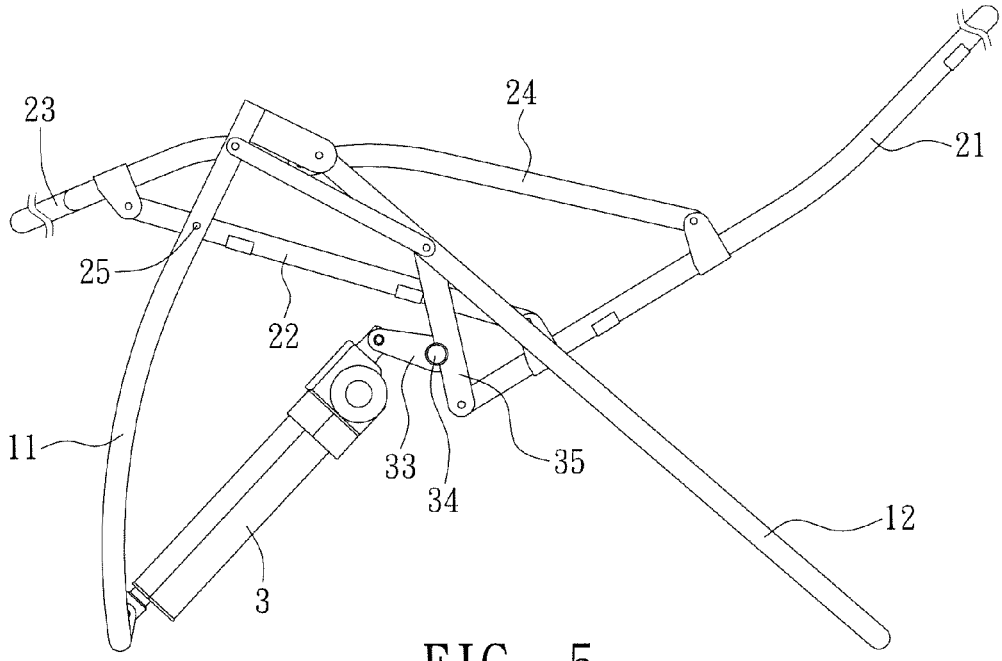
FIG. 5 is a side view showing a totally lying-on-the back status of the first preferred embodiment of the present invention.

With reference to FIGS. 3 to 5, when the chair is used for lying and a user (not shown in the figure) sits on the seat frame 22 with his back leaning against the back frame 21, the lift chair is driven to act by the interaction of the driving device 3 and the link 30 in the conditions as shown in FIGS. 4 and 5, and finally the user can lie on his back as shown in FIG. 5. More specifically, in the aforementioned motion, the driving device 3 is retracted, so that the connection part 33, the driving part 34 and the transmission part 35 are dragged, and the back frame 21, the seat frame 22, the foot frame 23 and the hand rails 24 of the seat mechanism 2 are operated like the four-bar linkage to produce a tilted effect, wherein the back frame 21 and the foot frame 23 are tilted to the positions close to a horizontal level.

Figure 7:
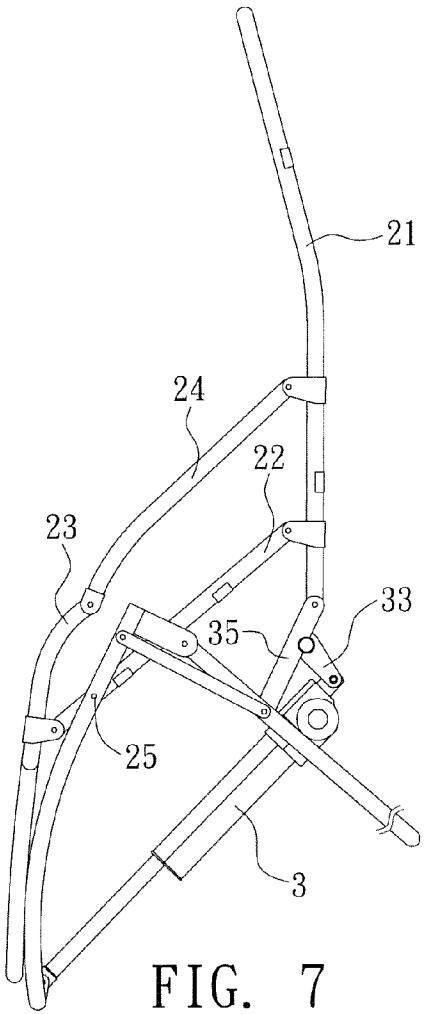
FIG. 7 is a side view showing a standing aid status of the first preferred embodiment of the present invention.
Figure 6:
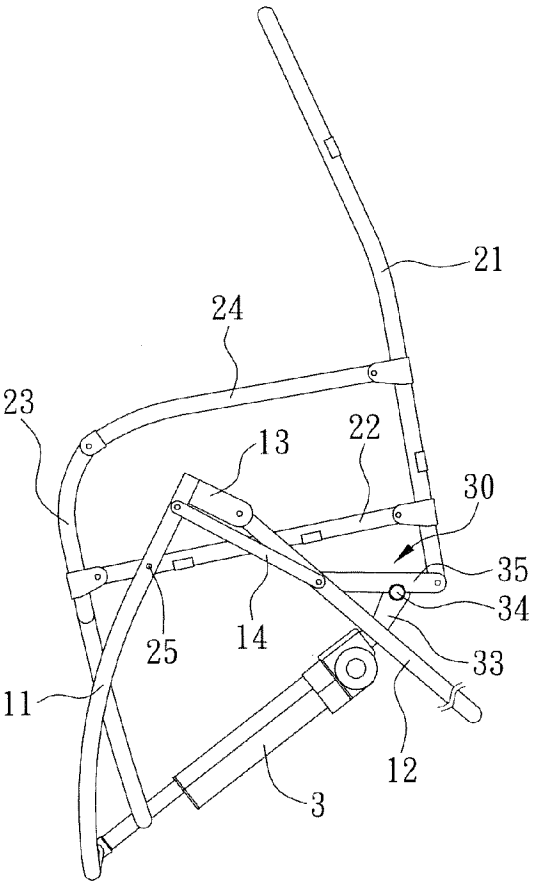
FIG. 6 is a side view showing a preliminary standing aid status of the first preferred embodiment of the present invention.
Figure 9:
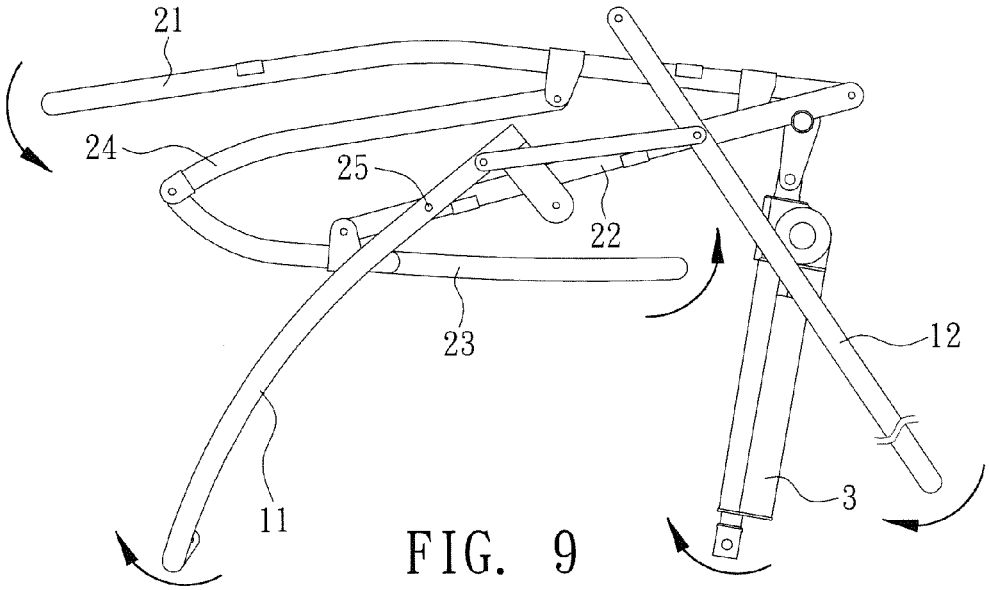
FIG. 9 is a side view showing a second storing motion of the first preferred embodiment of the present invention.
Figure 10:
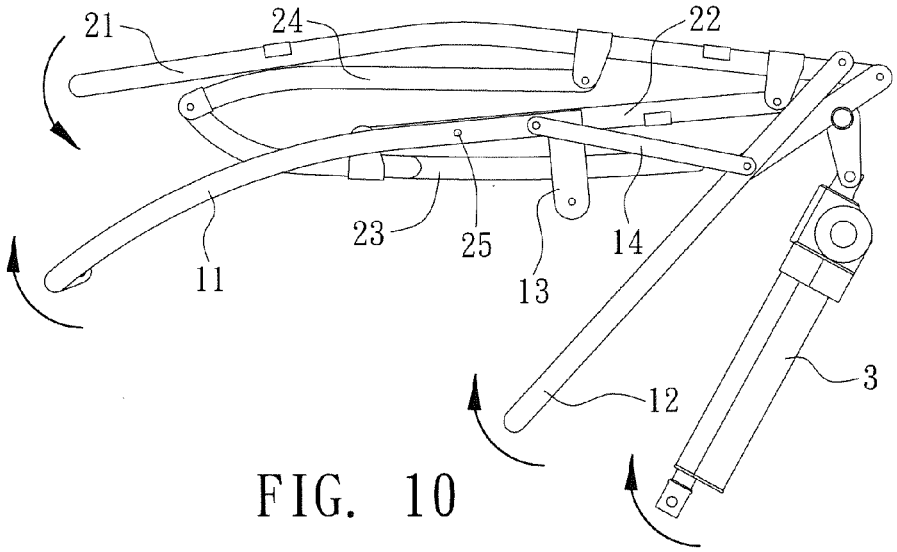
FIG. 10 is a side view showing a third storing motion of the first preferred embodiment of the present invention.

If the user wants to stand up from the chair (wherein the chair is situated at an initial status as shown in FIG. 3 or 5), the user can drive the chair by the interaction of the driving device 3 and the link 30, such that the chair is situated at a standing aid status as shown in FIGS. 6 and 7, and elderly users or people with mobility problems can be aided to stand up from the chair. More specifically, in the aforementioned motion, the driving device 3 is extended, so that the connection part 33, the driving part 34 and the transmission part 35 of the link 30 can be turned pivotally, and the back frame 21, the seat frame 22, the foot frame 23 and the hand rails 24 of the seat mechanism 2 can be operated like the four-bar linkage and the chair is almost erected, wherein the back frame 21 and foot frame 23 are both almost perpendicular to the ground, and the hand rails 24 and the seat frame 22 are tilted further from the original position shown in FIG. 3, so as to facilitate the user to hold the hand rails 24 by both hands when standing up from the chair, and the seat frame 22 produces an assisting pushing force to achieve the standing aid effect.

Figure 8:
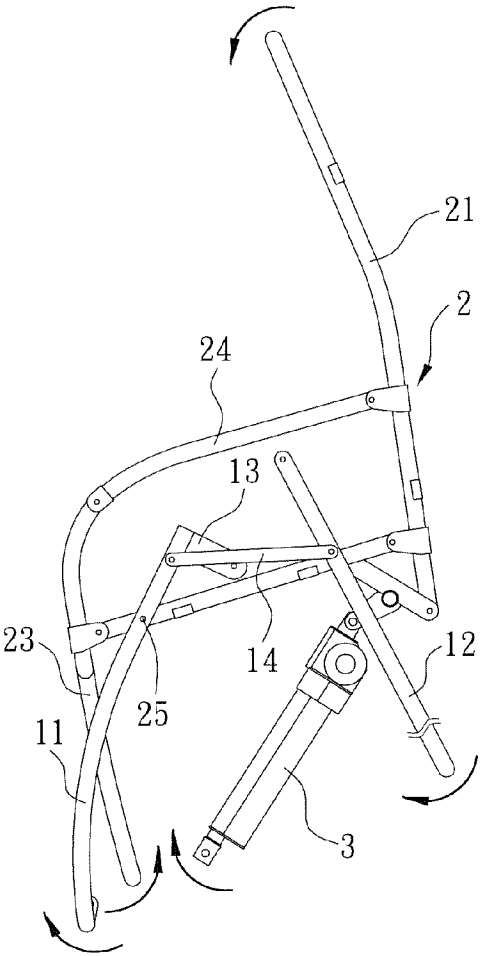
FIG. 8 is a side view showing a first storing motion of the first preferred embodiment of the present invention.
Figure 11:
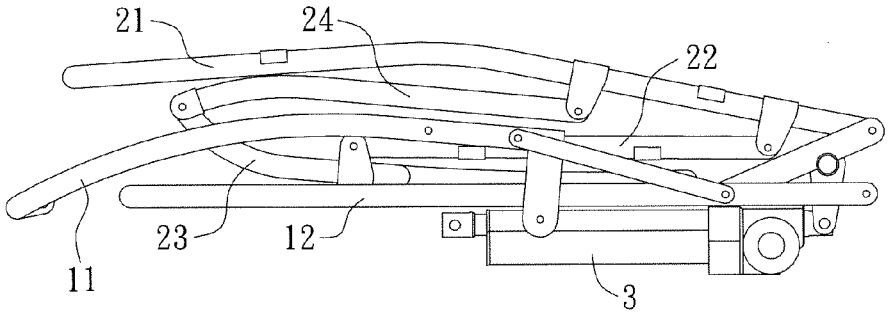
FIG. 11 is a side view showing a fourth storing motion of the first preferred embodiment of the present invention.
Figure 12:
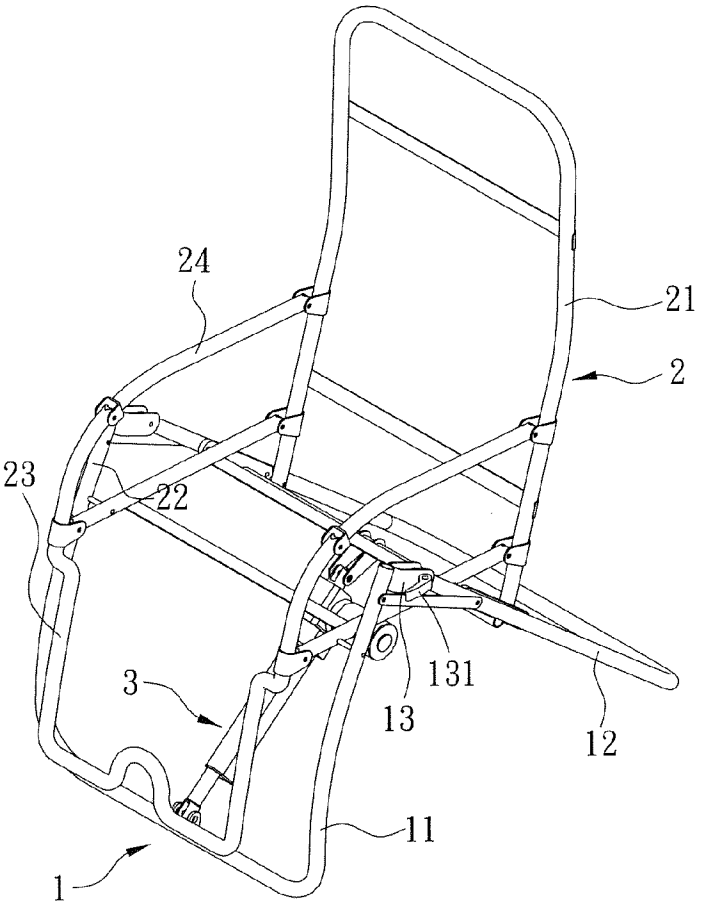
FIG. 12 is a schematic view showing a quick release structure installed at the position of a fixing element in accordance with the first preferred embodiment of the present invention.

In FIGS. 8 to 11, if the user wants to fold and store the lift chair of this preferred embodiment, the user can fold the chair by separating the fixing element 13 as shown in FIG. 8 from the front and rear base frames 11, 12, and separate an end of the driving device 3 from the bottom of the front base frame 11. In this preferred embodiment, the fixing element 13 is a component such as a bolt or a nut provided for the fixation, but other equivalent components can be used instead to achieve the requirements of the installation and removal design. In FIG. 12, a design of a quick release structure 131 at the fixing element 13 can be adopted to connect or separate the front and rear base frames 11, 12 quickly. To achieve the stacking and folding effects, separate front and rear base frames or driving device can be used in this preferred embodiment. Before the front and rear base frames are separated from the driving device, the total volume of the lift chair can be minimized.

In summation, this preferred embodiment adopts components such as bolts and nuts for securing the lift chair. If it is necessary to fold the lift chair, the bolts and nuts are removed first, so that the base 1, the seat mechanism 2 and the driving device 3 can be stacked and folded, wherein the front and rear base frames 11, 12 and the driving device 3 folded towards the front of the lift chair, and the back frame 21 and the foot frame 23 are pivotally turned towards the front and the rear of the lift chair respectively, and the related stacking and folding processes are indicated by arrows in FIGS. 8 to 10, and finally the folded lift chair is shown in FIG. 11. Therefore, the lift chair of the present invention does not occupy much storage or transportation space.

Figure 13:
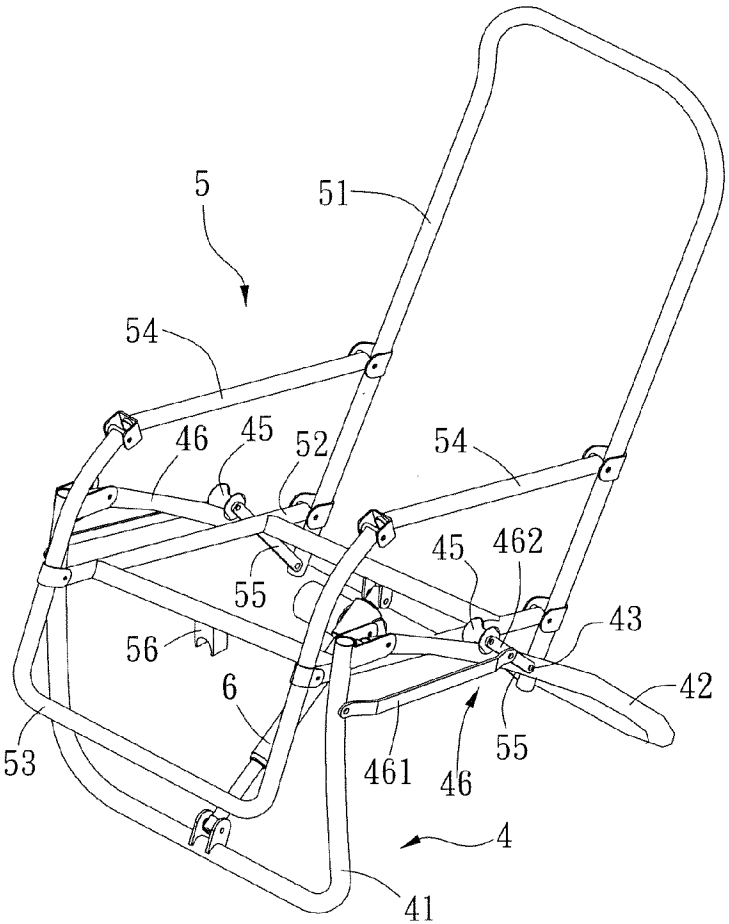
FIG. 13 is a perspective view of a second preferred embodiment of the present invention.
Figure 14:
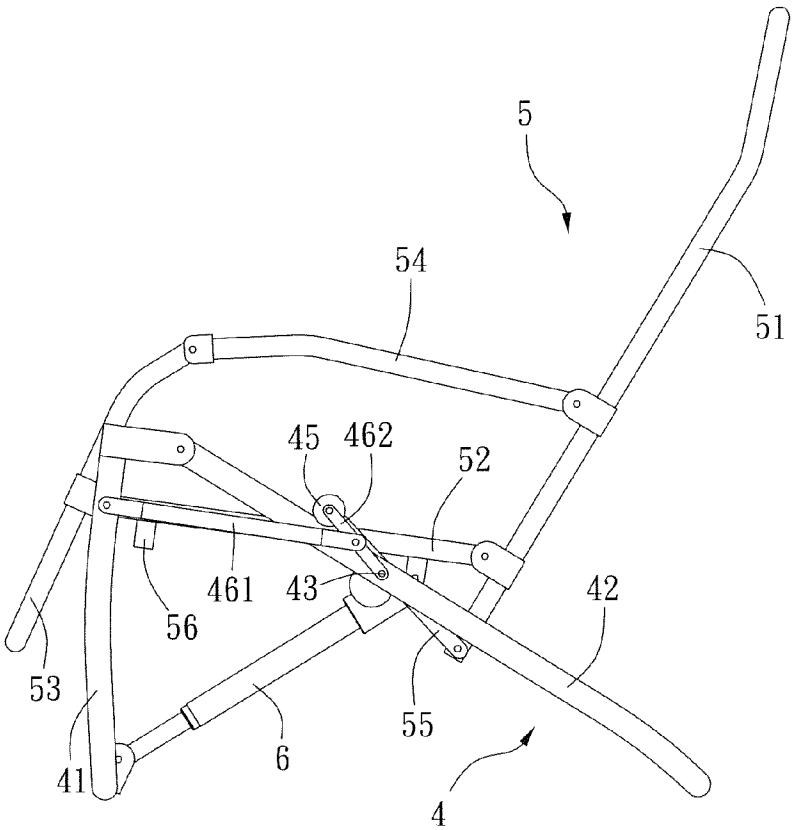
FIG. 14 is a side view of the second preferred embodiment of the present invention.

With reference to FIGS. 13 and 14 for the second preferred embodiment of the present invention, the lift chair of the second preferred embodiment comprises the following elements:

A base 4 includes a front base frame 41 and a rear base frame 42, both having a substantially U-shaped bent design, and the top of the front and rear base frames 41, 42 are coupled to each other, and the front and rear base frames 41, 42 are coupled by a connecting element 46 for limiting their relative positions, wherein the connecting element 46 includes a first rod 461 and a second rod 462, and an end of the first rod 461 is pivotally coupled to a body portion of the second rod 462, and another end of the first rod 461 is pivotally coupled to the front base frame 41, and an end of the second rod 462 is pivotally coupled to the rear base frame 42.

A seat mechanism 5 includes a back frame 51, a seat frame 52, a foot frame 53 and two hand rails 54, and the seat frame 52 is disposed between the front and rear base frames 41, 42, and a position proximate to an end of a front section of the seat frame 52 is pivotally coupled to both left and right sides of the top of the front base frame 41, and a distal portion of the front section of the seat frame 52 is pivotally coupled to both left and right sides of the foot frame 53, and a distal portion of the rear section of the seat frame 52 is pivotally coupled to both left and right sides of the bottom of the back frame 51, and both left and right sides of an end of the foot frame 53 are respectively and pivotally coupled to distal portions of the front section of the two hand rails 54, and the distal portions of the rear section of the two hand rails 54 are respectively and pivotally coupled to both left and right sides of the back frame 51, wherein the pivot position of the hand rails 54 and the back frame 51 is higher than the pivot position of the seat frame 52 and the back frame 51. Further, both left and right sides of the bottom of the back frame 51 are pivotally coupled to an end of a link 55, and another end of the link 55 is pivotally coupled to an end of the second rod 462 which is pivotally coupled to the rear base frame. Of course, the back frame 51 and the seat frame 52 can include a back cushion and a seat cushion (not shown in the figure) respectively provided for the user to sit or lean on the cushions.

A driving device 6 has an end pivotally coupled to the front base frame 41, and another end pivotally coupled to the rear section of the seat frame 52, and a pivot position of the seat frame 52 and the front base frame 41 is used as a rotating center, such that the driving device can be driven to turn the seat mechanism with respect to the base. Further, pivot position of the driving device 6 and the front base frame 41 can have a detachable design, so that when the lift chair is stored, the driving device 6 and the front base frame 41 can be separated for stacking and folding. The driving device 6 is a hydraulic cylinder, a pneumatic cylinder, a lifting motor or a linear actuator that can be operated stretchably, and the driving device 6 further includes an operating interface (not shown in the figure) provided for a user to control the motion or dynamic gesture of the lift chair.

Figure 16:
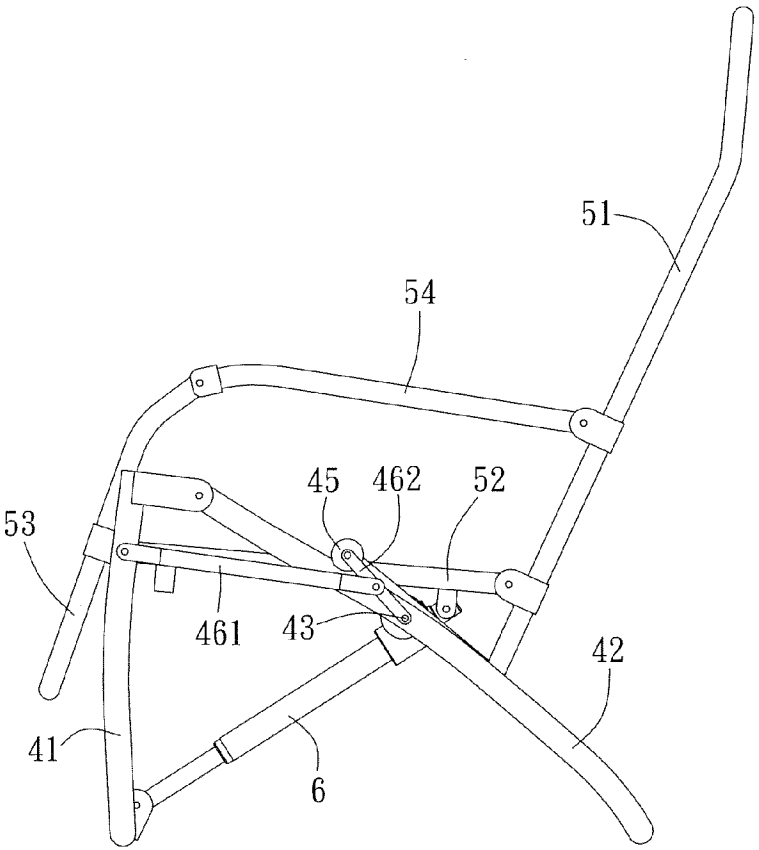
FIG. 16 is a side view showing a second standing aid motion in accordance with the second preferred embodiment of the present invention.
Figure 15:
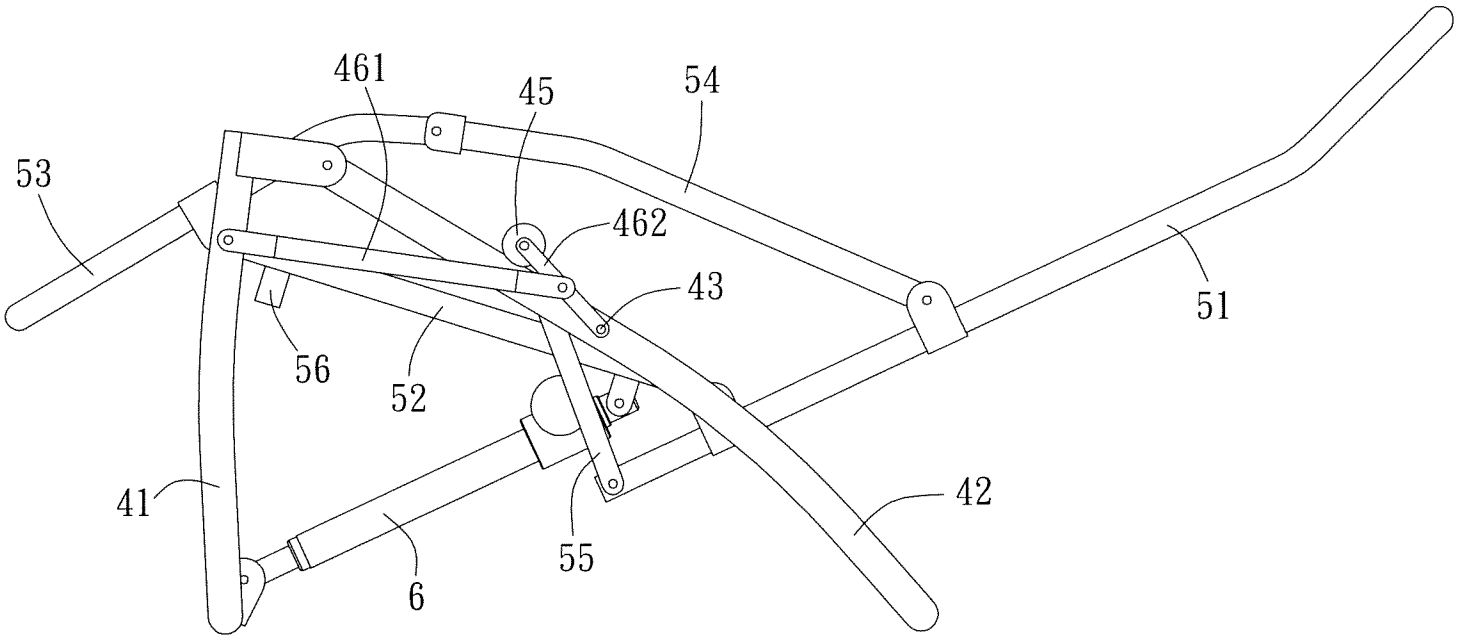
FIG. 15 is a side view showing a first standing aid motion in accordance with the second preferred embodiment of the present invention.
Figure 17:
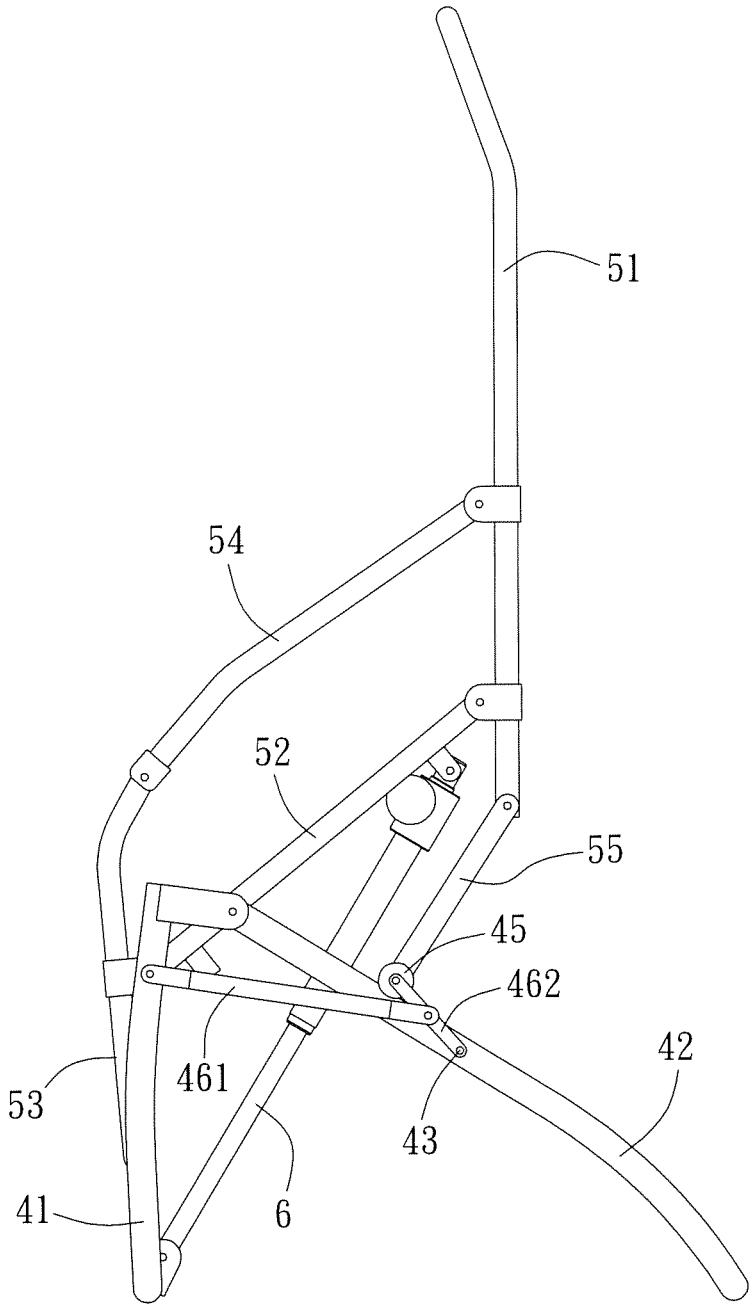
FIG. 17 is a side view showing a third standing aid motion in accordance with the second preferred embodiment of the present invention.
Figure 18:
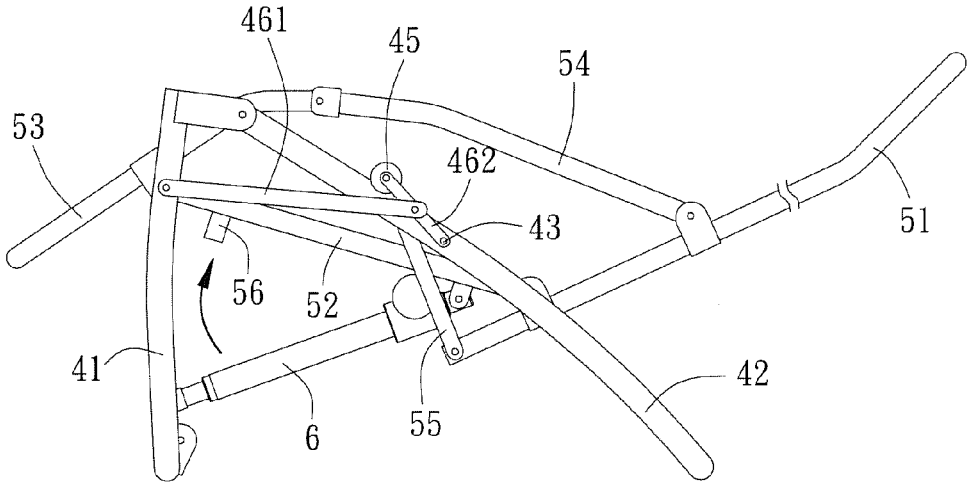
FIG. 18 is a side view showing a first storing motion of the second preferred embodiment of the present invention.
Figure 19:
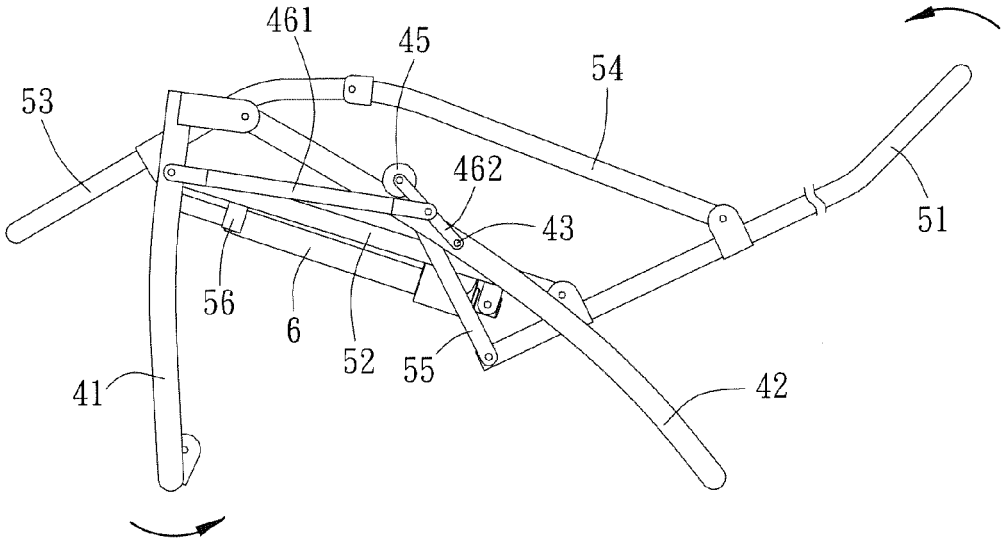
FIG. 19 is a side view showing a second storing motion of the second preferred embodiment of the present invention.
Figure 20:
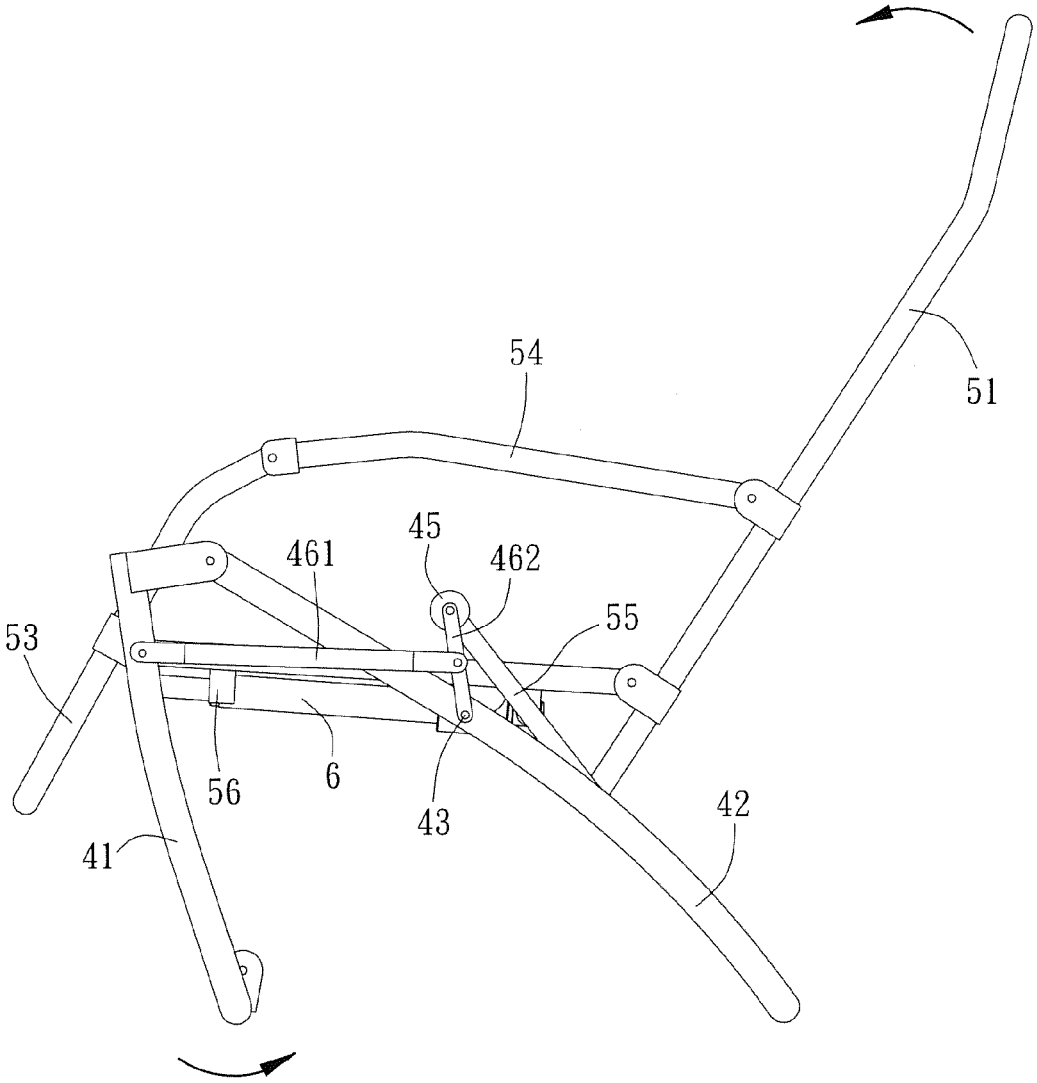
FIG. 20 is a side view showing a third storing motion of the second preferred embodiment of the present invention.
Figure 21:
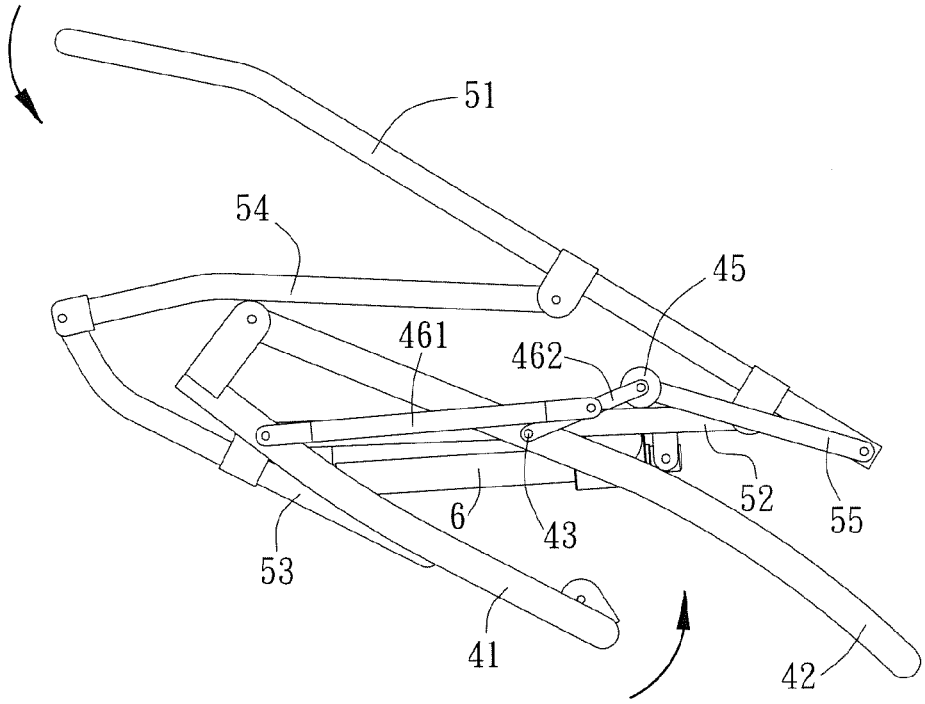
FIG. 21 is a side view showing a fourth storing motion of the second preferred embodiment of the present invention.

In a practical application of this preferred embodiment, the lift chair is situated at a lying-on-the-back status, and the motion of the driving device 6 is controlled to extend the driving device 6 to raise the seat frame 52, so that a pivot position of the seat frame 52 of the seat mechanism 5 and the front base frame 41 can be used as a pivot center, and the back frame 51, the seat frame 52, the foot frame 53 and the hand rails 54 of the seat mechanism 5 act like the four-bar linkage motion with respect to the base 4 as shown in FIGS. 15 to 17, and finally the lift chair is situated at a status as shown in FIG. 17, so that the user lied on the lift chair can support the user's body by the erected seat mechanism 5, so that the lift chair can provide a standing aid effect.

Figure 22:
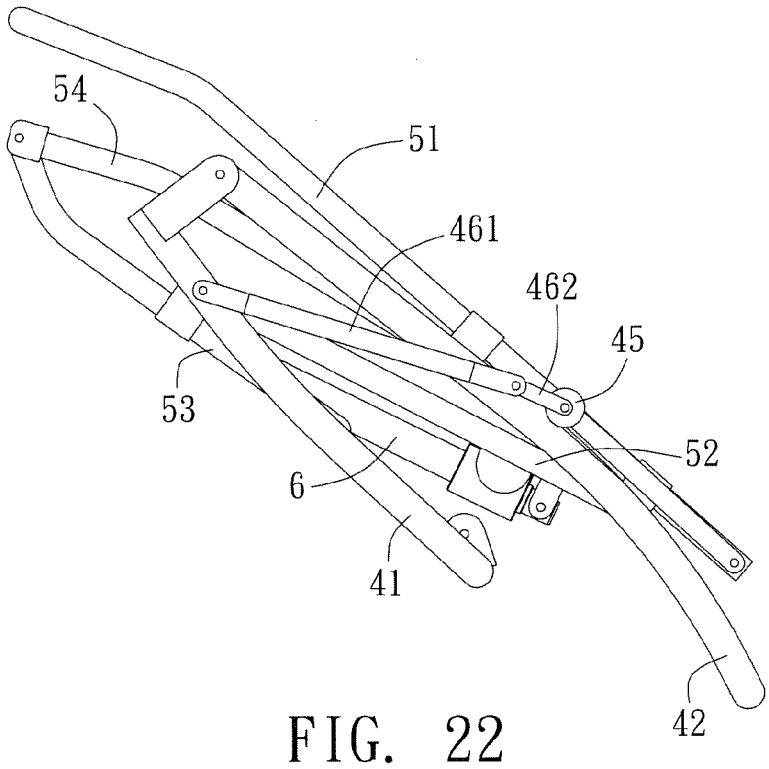
FIG. 22 is a side view showing a fifth storing motion of the second preferred embodiment of the present invention.
Figure 24:
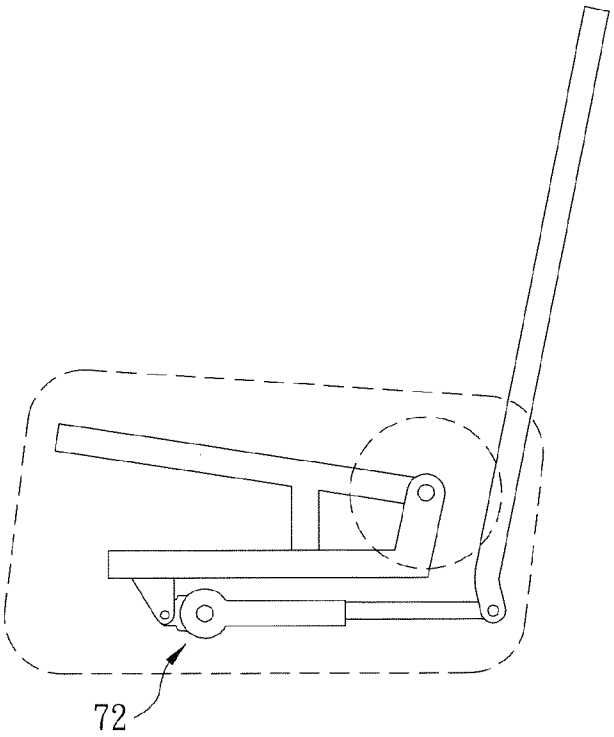
FIG. 24 PRIOR ART
FIG. 24 is a schematic view of another conventional chair.
Figure 23:
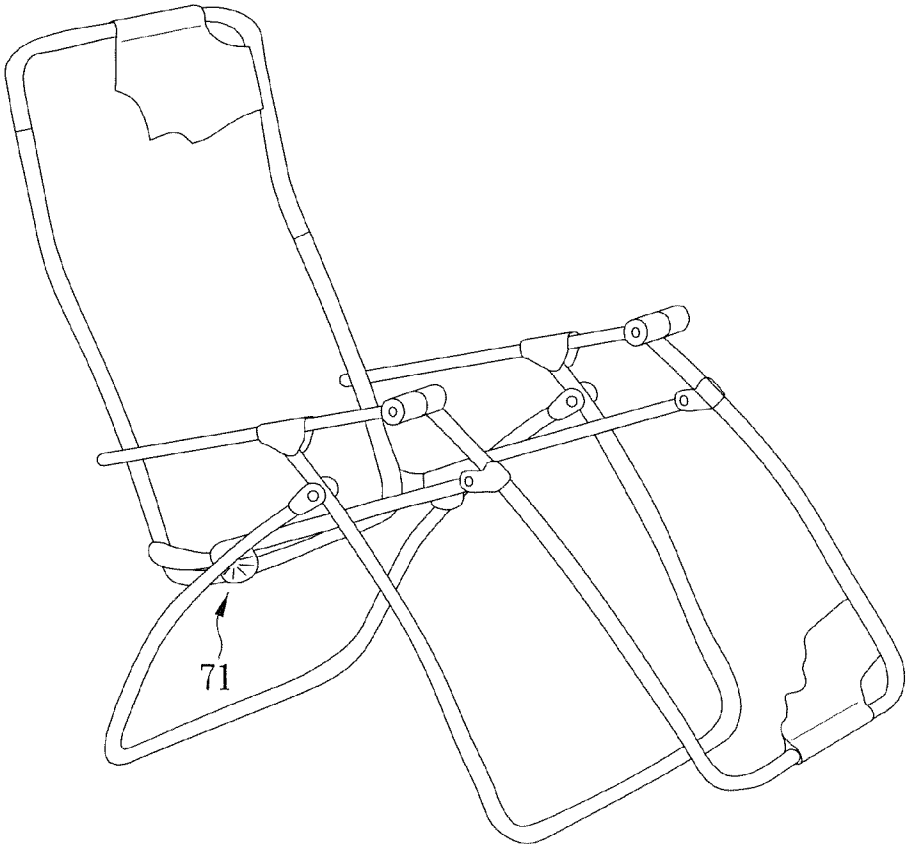
FIG. 23 PRIOR ART
FIG. 23 is a schematic view of a conventional chair.

With reference to FIGS. 18 to 22, when the lift chair of this preferred embodiment is stored, the driving device 6 is removed from the front base frame 41, and the driving device 6 is pivotally turned and fixed onto a positioning element 56 on the seat frame 52, and then the back frame 51 is turned forward. Now, the bottom of the back frame 51 will drive the link 55 to move backward to drive the second rod 462 to pivotally turn at the first pivot portion 43. When the second rod 462 is turned pivotally, the first rod 461 pivotally coupled to the second rod 462 is moved backward to pull the front base frame 41 backward and get closer to the rear base frame 42, and the forwardly turned back frame 51 also drives the hand rails 54, the seat frame 52 and the foot frame 53 to perform a four-bar-linkage motion, until the second pivot portion 45 of the second rod 462 is moved backward and stopped by the rear base frame 42. Therefore, the lift chair of this preferred embodiment can be stacked and folded to reduce the storage volume to facilitate the storage as shown in FIG. 22.

In summation of the description above, the present invention includes the seat mechanism installed on the base and driven by the driving device for its operation, and the pivot position of the seat frame of the seat mechanism and the front base frame of the base acts as the rotation center, so that the back frame, the seat frame, the foot frame and the hand rails of the seat mechanism can be driven by the driving device, and the seat frame drives the pivotally coupled back frame, hand rails and foot frame to perform a motion similar to the four-bar linkage. The invention allows users to lie on their backs, and aids elderly user or people with mobility problems to stand up from the chair. Compared with the conventional chair, the present invention provides a convenient and practical standing aid design.

What is claimed is:

1. A lift chair, comprising:

a base including a front base frame, a rear base frame, and a connecting element for limiting relative positions of the front base frame and the rear base frame;

a seat mechanism including a back frame, a seat frame, a foot frame and two hand rails, and a front section of the seat frame being pivotally coupled to the front base frame and the foot frame, and a rear section of the seat frame being coupled to the back frame, and an end of the foot frame being pivotally coupled to a front section of the two hand rails, and a rear section of the two hand rails being pivotally coupled to the back frame, and the bottom of the back frame being pivotally coupled to a link, and the link being pivotally coupled to the connecting element; and a driving device having an end pivotally installed at the front base frame and another end pivotally coupled to the seat frame, the seat frame and the front base frame being pivotally coupled at a pivot position acting as a rotation center;

wherein the driving device drives the seat frame between sitting and standing-aid positions, the back frame in the sitting position being disposed at a first angular orientation relative to the seat frame, the back frame in the standing-aid position being disposed at a second angular orientation relative to the seat frame, the first and second orientations being angularly offset one from the other, the foot frame and the hand rails being moved and pivoted between the sitting and standing-aid positions.

2. The lift chair of claim 1, wherein if an end of the driving device is detached from the front base frame, the base, the seat mechanism and the driving device can be stacked and folded.

3. The lift chair of claim 1, wherein the connecting element includes a first rod and a second rod, and an end of the first rod is coupled to the front base frame, and another end of the first rod is coupled to a body portion of the second rod, and an end of the second rod is coupled to the rear base frame, and another end of the second rod is coupled to the link.

4. The lift chair of claim 1, wherein the driving device is extendable, the driving device being selected from the group consisting of: a hydraulic cylinder, a pneumatic cylinder, a lifting motor, and a linear actuator.

* * * * *